United States Patent [19]

Britt

[11] 3,941,049

[45] Mar. 2, 1976

[54] CONTAINER CRUSHER

[75] Inventor: Russell Britt, Eureka, Calif.

[73] Assignee: Lawrence Peska Associates, Inc., New York, N.Y. ; a part interest

[22] Filed: Mar. 24, 1975

[21] Appl. No.: 561,055

[52] U.S. Cl. ..... 100/274; 100/DIG. 2

[51] Int. Cl.[2] ..... B30B 1/04

[58] Field of Search ..... 222/391; 241/99; 100/DIG. 2, 274

[56] References Cited

UNITED STATES PATENTS

| | | | |
|---|---|---|---|
| 2,191,488 | 2/1940 | McCowan | 100/274 X |
| 2,815,151 | 12/1957 | Collins | 222/391 X |
| 3,043,212 | 7/1962 | Hasselquist | 100/DIG. 2 |
| 3,299,802 | 1/1967 | Black | 100/DIG. 2 |
| 3,580,167 | 5/1971 | Simshauser | 100/DIG. 2 |
| 3,776,129 | 12/1973 | Carlson | 100/DIG. 2 |
| 3,780,647 | 12/1973 | Reimers | 100/DIG. 2 |

*Primary Examiner*—Billy J. Wilhite

[57] ABSTRACT

This disclosure pertains to a device for crushing containers within a housing by compressive forces created by an end plate on said housing and by a presser plate attached to a pivotable cover. Ratchet means are provided to create substantial forces of compression. The cover is locked in a slidable position by a disengageable tongue mounted on the cover slidably engaging a cam fastened to the housing. The cover is fully retractable and when in the retracted position can pivot open to permit easy insertion of the container into the housing.

6 Claims, 3 Drawing Figures

CONTAINER CRUSHER

BACKGROUND OF THE INVENTION

1. The Field of the Invention

This invention relates to a device which can crush containers, and more particularly metal cans used for foodstuffs and the like.

2. Description of the Prior Art

The prior art is complete with means to crush cans operated by foot and hand forces. The U.S. Pat. No. 3,043,212 to Hasselquist, July 10, 1962 and U.S. Pat. No. 3,776,129 to Carlson, Dec. 4, 1973 and the U.S. Pat. No. 3,780,647 to Reimers, Dec. 25, 1973 disclose varied devices utilizing hand forces to crush or flatten containers. None of the aforementioned patents employ a ratchet mechanism to supply compressive forces to the container to be crushed. U.S. Pat. No. 3,299,802 to Black, Jan. 24, 1967 discloses a container crusher operated by foot pressure or by hand pressure but achieve compression of the container between two hinged flat plates. U.S. Pat. No. 3,580,167 to Simshauser, May 25, 1971 discloses a container and waste compression device which obtains compressive forces by the rotation of a screw engaging a split nut, wherein said screw is preferably motor driven.

SUMMARY OF THE INVENTION

The container crusher disclosed herein obtains compressive forces by the use of a ratchet stepwise engaging a rod equipped with notches. Substantial forces are thus obtained without need for a cumbersome mechanism. Loading and ejectment means are provided for the container's simple insertion and removal from the housing of the crusher.

A primary object of the instant invention is to provide a portable inexpensive device for crushing containers.

Another object is to provide a means to load and unload said crusher easily.

Still another object is to provide a crusher which will not fatigue the user on repeated use thereof.

A further object is to provide a crusher which will produce a crushed container in sensibly collapsed position such that each end of the container is parallel to the other, thereby producing the smallest possible shape for a crushed container.

Another object is to provide a crusher which substantially totally encloses the container while the container is being crushed limiting thereby exposed sharp edges which have not been subjected to compressive forces.

These objects, as well as other objects, of this invention will become readily apparent after reading the following description of the accompanying drawings.

DESCRIPTION OF THE PREFERRED EMBODIMENT

The structure and method of fabrication of the present invention is applicable to container crushers where the compressive forces are obtained by use of a ratchet operating on a notched rod. Incremental urging of the ratchet through use of a mechanical linkage provides substantial mechanical advantage and produces a compressive force of great magnitude.

Figure 1:
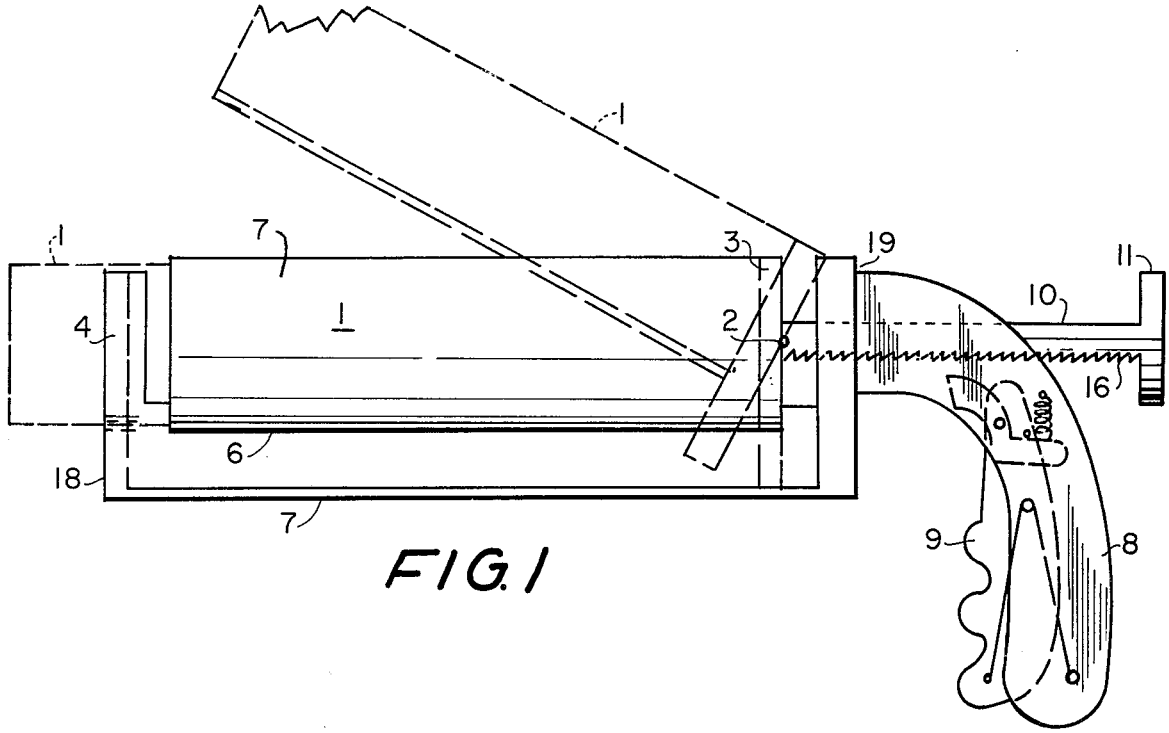
FIG. 1 is a side elevation view of the crusher depicting the cover in both closed and opened positions.

Now referring to the Figures, and more particularly to the embodiment illustrated in FIG. 1 showing the housing 7 as a hollow right angle cylinder with a portion of its surface removed. End plate 4 constitutes a heavy thick cap fastened to the cylinder for engagement with the container to be crushed (not shown). The cover illustrated in the closed position, is provided with a presser plate 3 which engages the container end during the crushing operation. The cover 1 is adapted with two tongues. Figure 1 shows one tongue 6 in a plane substantially parallel to the central longitudinal axis of the housing 7. Tongue 6 can engage cam 18 which has a slot 5 substantially parallel to the tongue 6, as depicted, when the cover 1 is in the closed position. Handles 8 and 9 comprise a mechanism for propelling the presser plate 3 towards the end plate 4 upon alternate squeezing and releasing of handles 8 and 9. Handle 8 is rigidly fastened to a mounting plate 19 which is parallel to end plate 4 located on the opposite end of the housing. Rod 10 passes through an opening 19' in plate 19. Rod 10 has a plurality of notches in its surface and is terminated in its free end with a handle 11, which is utilized to retract or withdraw the cover from its forwardmost urged position to the rearmost position of the cover which corresponds to the loading position of the device.

Figure 2:
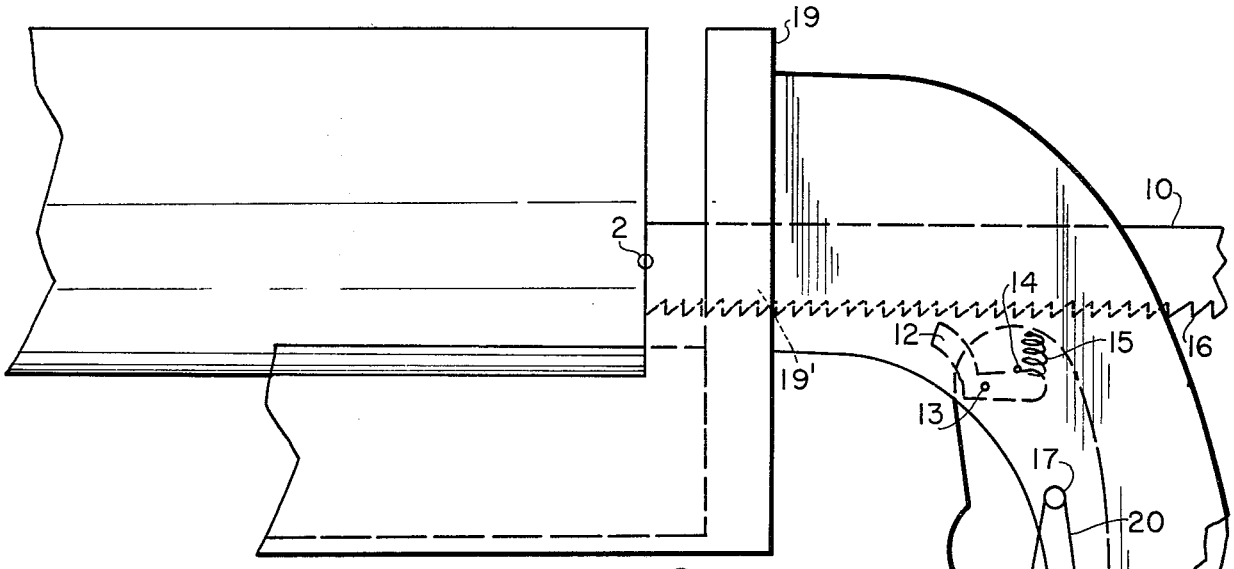
FIG. 2 is a fragmentary enlarged side elevation view of the crusher illustrating the ratchet and rod means.

Figure 2 shows the ratchet member 12 in engagement with a notch 16 of the rod 10. A spring 15 biases the ratchet dog into engaged position with a notch of the rod 10. When the rod is retracted towards the loading position, biasing spring 15 is overcome and the ratchet angularly rotates about a ratchet pivot pin 13. Stop pin 14 prevents unlimited counterclockwise rotation of ratchet 12 about its pivot point 13, said rotation created by the collapsing tendency of spring 15. Handle 9 is used to force the ratchet into the notch 16 and urges rod 10 towards end plate 4, by the motion imparted to hadle 9 when handles 8 and 9 are squeezed together at the free ends. When handles 8 and 9 are released the ratchet is free to engage another notch and in stepwise fashion cause the cover 1 to move substantially along the entire length of the housing. Spring 20 biases the free end of handles 8 and 9 open with moderate force easily overcome by the application of normal finger gripping forces upon handles 8 and 9. Pivot 17 permits the handles 8 and 9 to move in angular relationship to each other and to provide a fulcrum point needed to obtain substantial mechanical advantage between the squeezing forces of the fingers and the higher forward urging forces on the ratchet 12 acting upon the rod 10.

Figure 3:
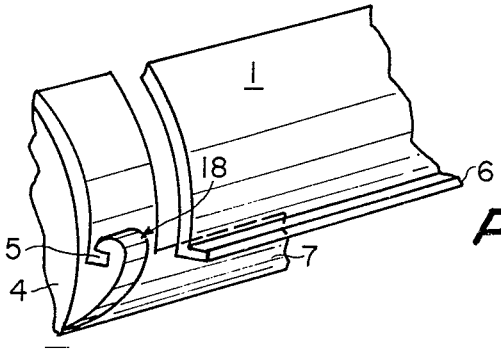
FIG. 3 is a fragmentary enlarged perspective view of the locking cam and tongue means of the cover.

FIG. 3 shows the cam 18 with a slot 5 cut into the inner surface of the cam. Cam 18 is rigidly fastened to end plate 4 and is adapted to receive tongue 6 of cover 1 when the cover is moved along the longitudinal axis of the housing. Tongue 6 is free of cam engagement when the cover is fully withdrawn towards the mounting plate 19, shown in FIGS. 1 and 2. Relatively few squeezing motions on handles 8 and 9 bring the cover to the position where tongue 6 can engage cam 18 by insertion into slot 5. The tongue remains in the slot throughout the compressing cycle comprised of further alternate squeezing and releasing motions of the handles 8 and 9.

When the container is crushed to a sufficient degree, the handle 11, shown on FIG. 1 is grasped and a force exerted thereupon in the direction away from the housing 7. No rotation of the rod 10 or the handle 11 is required. as illustrated, since the ratchet can stepwise disengage from the notches as the rod is pulled away from the housing. If pivot 2 is capable of rotational pivotability as well as angularly pivoting of the cover to the rod, then the rod may be withdrawn away from the housing without causing the ratchet to oscillate about its pivot point 13, by a simple 180° axial rotation of the rod from the position shown. The ratchet will then be in contact with a smooth surface of the rod and the rod, when returned to the position where the notches again engage the ratchet, and again is placed in the operable position, ready for the next use of the crusher.

One of the advantages of the novel container crusher disclosed herein is that only minimal forces must be employed by the user.

Another advantage lies in the ability to quickly load and unload the container into the crusher.

A further advantage is that the instant disclosure provides for the economical construction and simple use of a container crusher.

Still another advantage is obtained by almost totally enclosing the container, thereby minimizing the hazard of exposed sharp edges on the crushed container when it is made in the form of a metal can.

Another advantage is that the crushed container is reduced to its smallest possible crushed state where the ends of the container are parallel to each other separated only by the crushed side walls.

Thus, here is disclosed in the above description and in the drawings, embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

1. A device for crushing containers comprising, a stationary housing adapted with an end plate, said end plate supporting a cam on the surface thereof, a pivotable cover when in closed position partially covers said housing, means to slide said cover along the longitudinal axis of said housing, said cam including locking means to maintain locked said cover in the closed position when said cover slides along a fixed portion of the length of said housing, means to pivot said cover to an angular relationship with said housing when said locking means are not engaged, ratchet means to forcibly slide said cover, said cover adapted with a presser plate substantially parallel to said end plate when the cover is in a closed or locked position, said pivot means pivotly connecting said ratchet means to the cover, a mounting plate mounted to said housing on an end opposed to said end plate, a portion of said ratchet means passing through said mounting plate and being connected to said presser plate.

2. The container crusher as claimed in claim 1 wherein tongue means extends parallel to the longitudinal axis of said cover, and the cam of said locking means comprises a stationary element providing selective locking engagement with said tongue means.

3. The container crusher as claimed in claim 1 wherein said portion of said ratchet means further comprises an elongated notched rod a ratchet dog, said dog adapted to stepwise engage said notches in said rod, said rod terminated on a free end with a handle, said pressure plate connected by said pivot means to said rod.

4. The container crusher as claimed in claim 3 wherein said ratchet dog disengages said notches in said rod upon applying a moderate force upon said handle along the longitudinal axis of said cover in the opposite direction of said housing.

5. The container crusher as claimed in claim 3 further comprising biasing means operable upon said ratchet to engage said ratchet into the said notches of the said rod.

6. The container crusher as claimed in claim 3 wherein said ratchet means further comprises fixed handle means, said fixed handle means fastened to the said mounting plate and supporting a pivot engaging a movable handle, said movable handle provided with a pivot supporting said ratchet dog whereby alternate angular rotations between said fixed and movable handles causes said ratchet dog to stepwise engage sequentially the notches in said rod, urging said rod and presser plate longitudinally towards the end plate to crush a container therebetween.

* * * * *